US007040571B1

(12) United States Patent
Broberg

(10) Patent No.: US 7,040,571 B1
(45) Date of Patent: May 9, 2006

(54) SINGLE PULL CONTROL HORN

(75) Inventor: James E. Broberg, Crystal Lake, IL (US)

(73) Assignee: Du-Bro Products, Inc, Wauconda, IL (US)

( * ) Notice: Subject to any disclaimer, the term of this patent is extended or adjusted under 35 U.S.C. 154(b) by 102 days.

(21) Appl. No.: 10/817,097

(22) Filed: Apr. 2, 2004

Related U.S. Application Data

(63) Continuation-in-part of application No. 10/617,135, filed on Jul. 10, 2003, now Pat. No. 6,755,376.

(51) Int. Cl.
*B64C 13/28* (2006.01)

(52) U.S. Cl. ..... 244/75.1; 244/221; 244/232; 244/87; 446/66; 403/56

(58) Field of Classification Search ..... 244/189, 244/221, 232, 233, 234, 88, 87, 89, 231, 244/75 R; 403/56, 71, 76, 90, 408.1; 411/537, 411/538
See application file for complete search history.

(56) References Cited

U.S. PATENT DOCUMENTS 3,382,630 A * 5/1968 Chivers ..... 52/208
3,422,721 A * 1/1969 Yonkers ..... 411/369
5,697,650 A * 12/1997 Brown ..... 285/197

OTHER PUBLICATIONS

OMNI Models, http://www2..omnimodels.com/cgi-bin/woi0001p?&I=DUBQ1863&P=O.*
Tower Hobbies Dubro Heavy Duty Control Horn; http://www2.towerhobbies.com/cgi-bin/wti0001p?&I=LXEMF9&P=O.*
Dubro.com Catalog.*

* cited by examiner

*Primary Examiner*—Jeffrey L. Gellner
*Assistant Examiner*—T D Collins
(74) *Attorney, Agent, or Firm*—Mathew R.P. Perrone, Jr.

(57) ABSTRACT

The present invention concerns a single pull horn with a control arm that may be used to control the movement of a component of a remote or radio-controlled vehicle having a center line. The control arm includes a threaded rod as well as a base member. The base member is positionable on the side of the component.

16 Claims, 4 Drawing Sheets

SINGLE PULL CONTROL HORN

CROSS-REFERENCE TO RELATED APPLICATION

This application is a continuation in part of U.S. patent application Ser. No. 10/617,135, now U.S. Pat. No. 6,755,376 filed Jul. 10, 2003, by the same inventor, incorporated herein by reference.

This invention relates to a single control horn and more particularly to a single pull control horn which has a control arm that may be used to control the movement of a component of a radio-controlled vehicle having a center line.

BACKGROUND OF THE INVENTION

In the remote control field, control arms and the like are often used to control the movement of various components or pieces of equipment. Mounting of such a control arm can create a difficult problem.

For example, a control rod will often be used to control the movement of a rudder used on a remote control airplane. However, because the outer surface of the rudder is angled, securing a control arm so that it is perpendicular to the center line of the component is often difficult. This is so because the clamping members used with a control arm are only designed to work on flat surfaces. Thus, when an angled surface is encountered, the clamping members cannot either fully engage the surface. Neither is it permitted for the clamping member to dig into the surface, as is often the case.

Many times, shims or inserts are used to overcome the problem of attaching the control arms to an angled surface. However, the shims or inserts upset the balance of the remote control vehicle. Thus, there are advantages to avoiding shims or inserts.

SUMMARY OF THE INVENTION

Among the many objectives of this invention is the provision of a single pull control horn for a remote control vehicle.

A further objective of this invention is the provision of a single pull control horn for a remote control vehicle adapted to be securely attached to a curved surface.

Yet a further objective of this invention is the provision of a single pull control horn with a clamping member which can fully engage the surface.

A still further objective of this invention is the provision of a single pull control horn with a clamping member which can avoid digging into the surface.

Yet another objective of this invention is the provision of a single pull control horn with a clamping member which can avoid the use of a shim on the surface.

Still, another objective of this invention is the provision of a single pull control horn with a clamping member which can avoid the use of an insert on the surface.

These and other objectives of the invention (which other objectives become clear by consideration of the specification, claims and drawings as a whole) are met by providing a single pull control horn which has a control arm that may be used to control the movement of a component of a remote or radio-controlled vehicle having a center line, and which control arm includes a base member mounted on a threaded rod.

BRIEF DESCRIPTION OF THE DRAWINGS

These and other features, objects and advantages of the present invention will become apparent from the following description and drawings wherein like reference numerals represent like elements in several views and in which.

Throughout the figures of the drawings, where the same part appears in more than one figure of the drawings, the same number is applied thereto.

DESCRIPTION OF THE PREFERRED EMBODIMENTS

The present invention permits the use of single pull horn with a control arm fitting on an angled surface by providing clamping members that have movable portions. The moveable sections conform to the angle of the support surface so as to maintain the control arm perpendicular to the center line of the component.

The present invention relates to a novel single control horn for use with remote-controlled apparatus including, but not limited to, aircraft, water craft, and land vehicles. More specifically, the present invention provides a base member that maintains a control rod in a position that is perpendicular to a central axis no matter the angle of the outer surface of the component to be controlled This control arm may be used to control the movement of a component of a remote or radio-controlled vehicle having a center line. The control arm includes a threaded rod as well as a base member. One short clamping member is positionable on each of the opposing sides of the component surface. Each short clamping member has a planar surface and an opposingly located raised section; that, in turn, has an outer surface being partially spherical in shape.

An opening is located in each of the clamping members which extends through the clamping members. Also provided is a locking member, having a cavity shaped to engage the spherical section of the clamping member and an internally threaded bore which coacts with the threaded rod. The coaction between the threaded portions creates a biasing force which urges the base members against the components. The engagement of the cavity and spherical section permit the base member to be moveable with respect to the locking member so as to maintain the threaded rod perpendicular to the centerline of the component, even though the outer surface of the component may not be perpendicular to that centerline.

Figure 1:
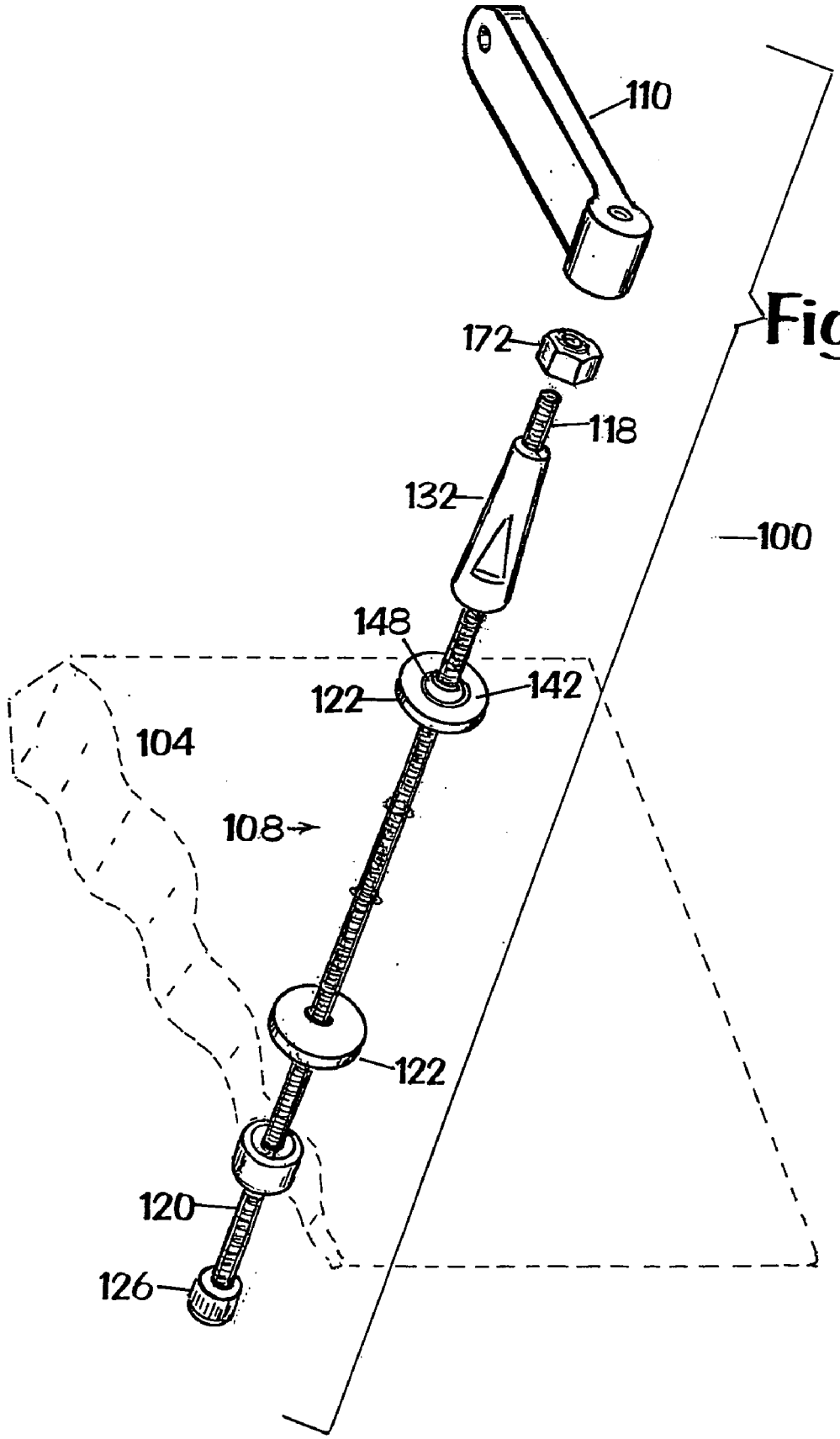
FIG. 1 depicts an exploded, perspective view of the single pull horn 100 of this invention mounted on remote controlled equipment 102.

As shown in FIG. 1, the present invention concerns a single pull horn 100 having a control arm 110 with a threaded gripping rod 118 mating with a clamp assembly 108. Clamp assembly 108 has base or clamping member 122, with threaded locking member 132 to cooperate therewith. Threaded locking member 132 also includes female internal threads 134 in order to receive male threaded rod member 120.

Threaded gripping rod 118 includes a male threaded rod member 120 permanently or releasably secured to a cap nut 126. Cap nut 126 permits threaded gripping rod 118 to be applied as desired to the single pull horn 100 in a desired position at threaded rod member 120.

Figure 2:
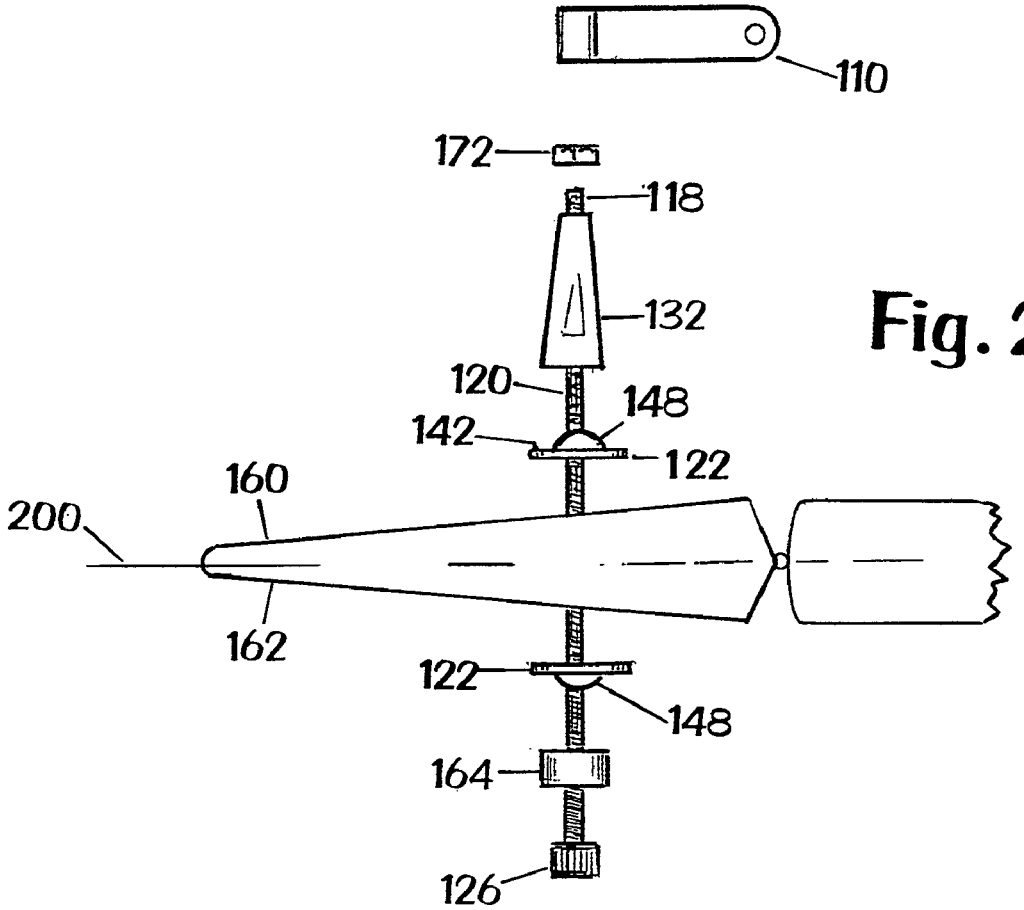
FIG. 2 depicts an exploded, side view of the single pull horn 100 of this invention based on FIG. 1.
Figure 3:
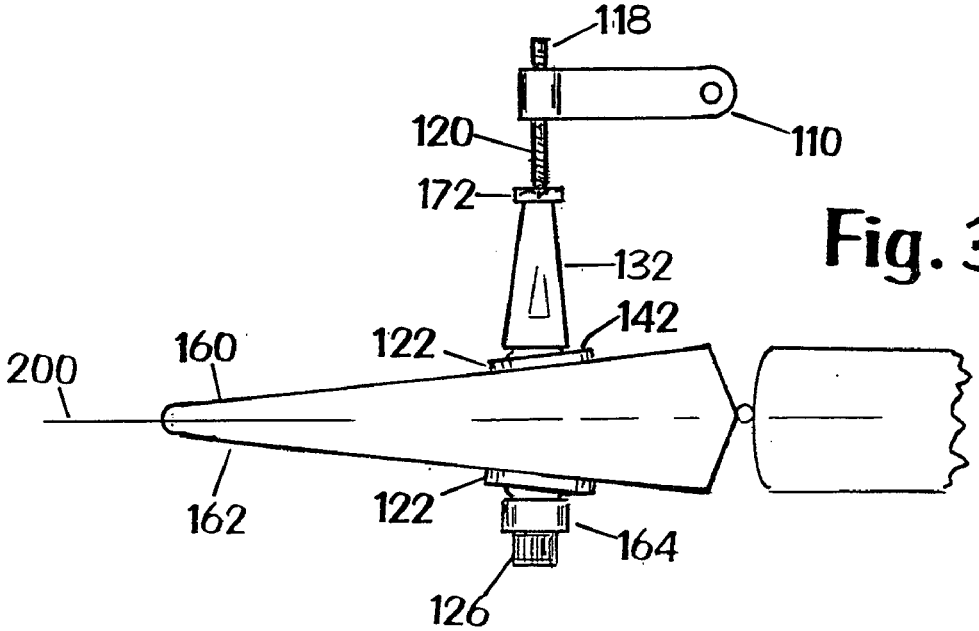
FIG. 3 depicts an assembled, side view of the single pull horn 100 of this invention based on FIG. 2.
Figure 4:
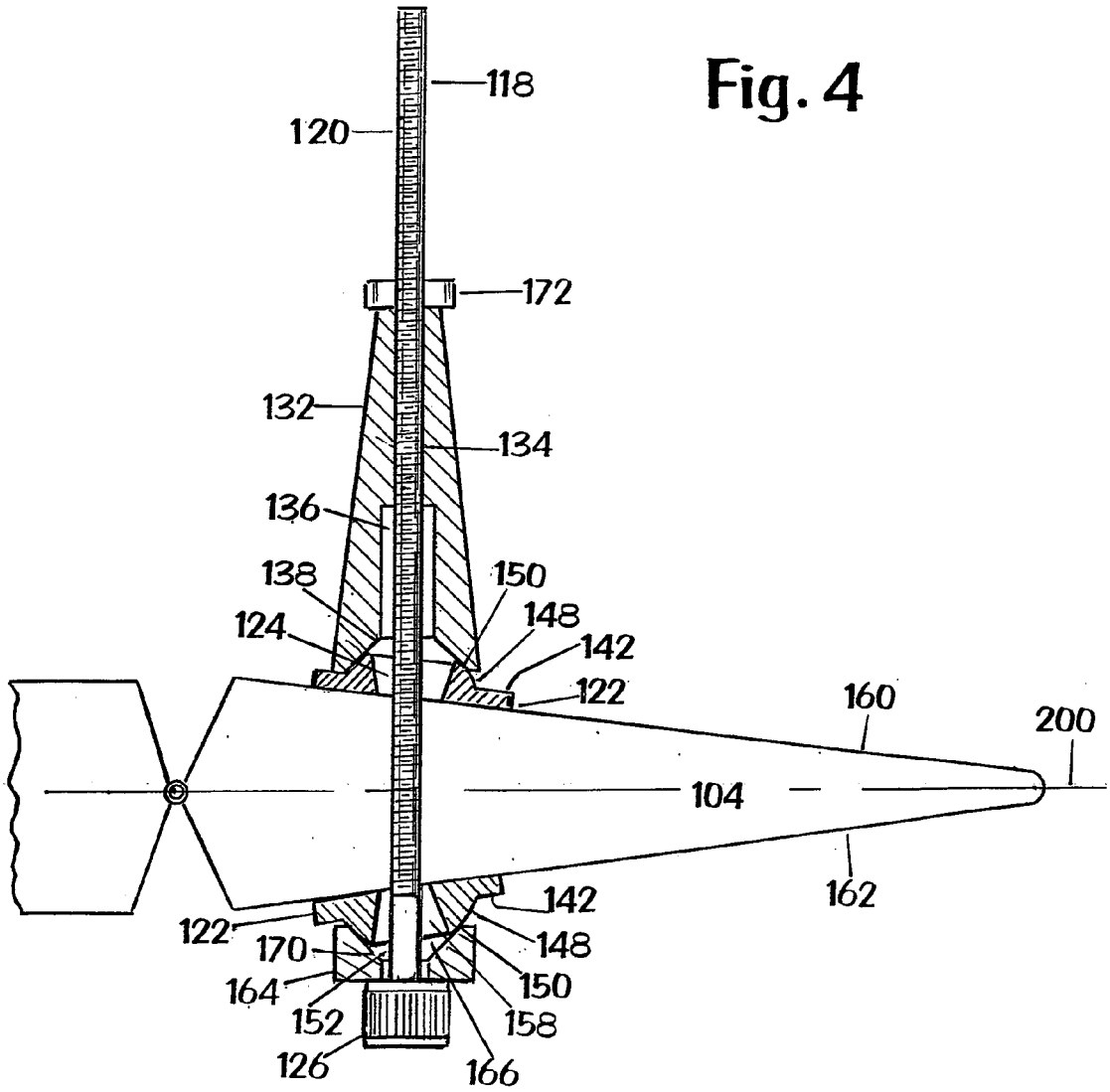
FIG. 4 depicts an assembled, side view of the single pull horn 100 of this invention in partial cross-section based on FIG. 3.
Figure 5:
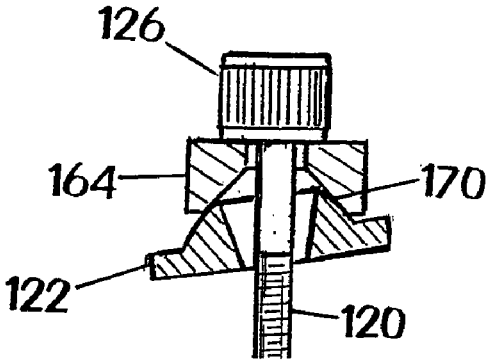
FIG. 5 depicts an assembled, side view of a clamp assembly 108 for the single pull horn 100 of this invention in partial cross-section based on FIG. 4.
Figure 6:
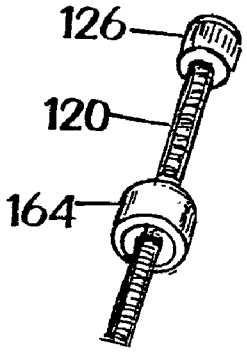
FIG. 6 depicts a perspective view of threaded gripping rod 118 for the single pull horn 100 of this invention.
Figure 7:
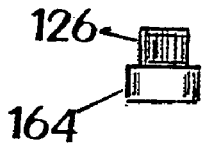
FIG. 7 depicts a side view of a cap nut 126 for threaded gripping rod 118 of the single pull horn 100 of this invention.
Figure 8:
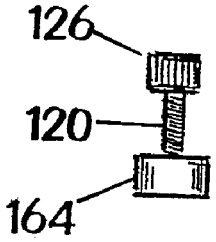
FIG. 8 depicts a side view of a cap nut 126 on threaded gripping rod 118 for the single pull horn 100 of this invention.

Adding FIG. 2, FIG. 3 and FIG. 4 to the consideration, threaded locking member 132 includes internal threads 134 located in bore 136 thereof. Also provided is a cavity 138 therein, which is shaped to complement of base or clamping member 122. Clamping member 122 includes a planar surface 142 and a raised section 148, which may include a partially spherical outer surface 150. Extending through clamping member 122 is a clamp opening 158, which increases in size from the planar surface to the outer surface.

With the further consideration of FIG. 5, FIG. 6, FIG. 7 and FIG. 8, in use, threaded rod member 120 of gripping rod 118 is first placed through small locking member 128, through base member 122 and then through a component 104 of remote or radio-controlled equipment 102. In this example, the equipment 102 may be an airplane and component 104 may be a rudder. However, other equipment and components will work with the present invention as well.

Once threaded gripping rod 118 is in position through component 104, a second base member 122 is inserted over threaded gripping rod 118 as shown in FIG. 1, FIG. 2, FIG. 3 and FIG. 4. Next, long threaded locking member 132 is threaded onto the gripping rod 118 in contact with internal threads 134. As the locking member 132 engages the base member 122, a biasing force is generated which urges the member 122 against the component 104, thereby securing the control arm 110 to the component 104.

As also shown in FIGS. 1 to 4, the interaction between the raised section 148 protruding from planar surface 142 of the base member 122 and cavity 138 or socket of the locking member 132 permits base member 122 to move with respect to the locking member 132. This, in turn, permits the planar surface to change to an angle that conforms to the angle of the component 104 without requiring the angle of the gripping rod 118 to be changed.

As shown in FIG. 2, this permits gripping rod 118 to maintain a perpendicular alignment with respect to the centerline 200 of component 104 even though the outer surfaces which are engaged by the clamping member are not perpendicular to the centerline. The tapered shape of the opening 124 further permits the clamping members 122 above and below component 104 to move with respect to the locking members 132 by eliminating interference with gripping rod 118.

The base member 122 has a planar surface 142 and an opposingly located raised section 148 that has an outer surface 150 that is partially spherical in shape. A base opening 156 is located in each of the base member 122 which extends through the base member 122.

Also, provided is a locking member 132 on component 104. Locking member 132 has a locking cavity 140 shaped to engage the spherical outer surface 154 of the clamping member 122 and an internally threaded bore 136, which coacts with the threaded gripping rod 118. The coaction between the threaded portions creates a biasing force which urges the base members against the component 104. The engagement of the cavity 138 and spherical section 138 permit the base member 122 to be moveable with respect to the locking member 132, so as to maintain the gripping rod 118 perpendicular to the centerline of the component 104.

Cooperating with the threaded locking member 132 on the topside 160 of component 104, and on the bottom side 162 of component 104, is open locking member 164. Open locking member 164 has an open side 166 adjacent to a second base or clamping member 122 on bottom side 162. Open side 166 has a trapezoidal shape 170 in order to permit cooperation with raised section 148 of clamping member 122 located on bottom side 162.

Cap nut 126 applies threaded rod member 120 of threaded rod 118, forces open locking member 164 to open and abut against clamping member 122, and cooperates with threaded locking member 132 in order to position threaded gripping rod 118. With threaded gripping rod 118 thus positioned control arm 110 can be applied thereto in threaded relation therewith. If desired, holding nut 172 can be positioned between control arm 110 threaded locking member 132 for additional holding power.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A single pull control horn for controlling movement of a component of a radio-controlled vehicle, comprising:

(a) a threaded locking member, a positioning means for a threaded gripping rod, and a control arm being mounted on the threaded rod member;

(b) the positioning means controlling a position of the threaded gripping rod;

(c) the threaded locking member controlling a position of the control arm;

(d) the positioning means including a cap nut mounted on the threaded gripping rod;

(e) the positioning means including a first short clamping member and a first base member; and (f) a transverse axis of the control arm being perpendicular to a central axis of the component.

2. The single pull control horn of claim 1 further comprising:

(a) the threaded locking member being supported by a second short clamping member while mounted on the threaded rod;

(b) the first short clamping member and the first base member being on a first side of the component;

(c) the cap nut and the second short clamping member being on a second side of the component; and (d) the second side of the component been oppositely disposed from the first side of the component.

3. The single pull control horn of claim 2 further comprising:

(a) the threaded gripping rod passing through the first short clamping member, the first base member, the component, the second short clamping member, and the threaded locking member, sequentially; and (c) the control arm being mounted on the threaded gripping rod.

4. The single pull control horn of claim 3 further comprising:

(a) the first short clamping member and the second short clamping member being similar in shape;

(b) the first short clamping member having a planar surface and an opposingly located raised section; and (c) the raised section having an outer surface that is partially spherical in shape.

5. The single pull control horn of claim 4 further comprising:

(a) a first opening being located in the first short clamping member;

(b) a second opening being located in the second short clamping member; and (c) the first opening and the second opening receiving the threaded gripping rod.

6. The single pull control horn of claim 5 further comprising:

(a) the threaded locking member having a cavity;

(b) the cavity being adapted to engage the raised section of the clamping member and assist with a positioning of the threaded rod;

(c) the threaded locking member having an internally threaded bore;

(d) the threaded gripping rod coacting with the internally threaded bore; and (e) the first short clamping member, the first base member, the second short clamping member, and the threaded locking member cooperating to position the threaded rod member.

7. The single pull control horn of claim 6 further comprising:

(a) the threaded locking member having a cavity;

(b) the cavity being adapted to cooperate with an opposingly located raised section of the second short clamping member; and (c) the cavity assisting with a position of the threaded gripping rod.

8. The single pull control horn of claim 7 further comprising:

(a) the cavity creating a coaction between an opposingly located raised section of the second short clamping member;

(b) the threaded locking member having an adjustable position relative to the second short clamping member in order to position the threaded; and (c) the first short clamping member, the first base member, the second short clamping member, and the threaded locking member coacting to position the threaded gripping rod in a desired position.

9. The single pull control horn of claim 8 further comprising:

(a) the threaded gripping rod being substantially perpendicular to a centerline of a component; and (b) the cavity having a tapered shape, thereby permitting the first clamping member and the second clamping to move by eliminating interference with the threaded gripping rod.

10. The single pull control horn of claim 9 further comprising:

(a) the first base member having a planar surface in contact with the component and an opposingly located raised section;

(b) the opposingly located raised section having an outer surface at least partially spherical in shape;

(c) the first base member having a base opening;

(d) the base opening extending through the base member; and (e) the base opening receiving the threaded rod therethrough.

11. The single pull control horn of claim 10 further comprising:

(a) the cavity engaging the spherical outer surface of the clamping member;

(b) the cavity engaging communicating with and an internally threaded bore of the threaded gripping rod.

12. A single pull control horn for controlling movement of a component of a remote-controlled vehicle, comprising:

(a) a threaded locking member, a positioning means for a threaded gripping rod, and a control arm being mounted on the threaded gripping rod;

(b) the positioning means controlling a position of the threaded gripping rod;

(c) the threaded locking member controlling a position of the control arm;

(d) the positioning means including a cap nut mounted on the threaded gripping rod;

(e) the positioning means including a first short clamping member and a first base member;

(f) the positioning means maintaining a transverse axis of the control arm perpendicular to a central axis of the component; and (g) the control arm serving to guide the remote controlled vehicle.

13. The single pull control horn of claim 12 further comprising:

(a) the threaded locking member being supported by a second short clamping member while mounted on the threaded gripping rod;

(b) the first short clamping member and the first base member being on a first side of the component;

(c) the cap nut and the second short clamping member being on a second side of the component;

(d) the second side of the component been oppositely disposed from the first side of the component;

(e) the threaded gripping rod passing through the first short clamping member, the first base member, the component, the second short clamping member, and the threaded locking member, sequentially; and (f) the control arm being mounted on the threaded locking member.

14. The single pull control horn of claim 13 further comprising:

(a) the first short clamping member and the second short clamping member being similar in shape;

(b) the first short clamping member having a planar surface and an opposingly located raised section; and (c) the raised section having an outer surface that is partially spherical in shape.

15. The single pull control horn of claim 14 further comprising:

(a) a first opening being located in the first short clamping member;

(b) a second opening being located in the second short clamping member;

(c) the first opening and the second opening receiving the threaded gripping rod;

(d) the threaded locking member having a cavity;

(e) the cavity being adapted to engage the raised section of the clamping member and assist with a positioning of the threaded gripping rod;

(f) the threaded locking member having an internally threaded bore;

(g) the threaded gripping rod coacting with the internally threaded bore;

(h) the first short clamping member, the first base member, the second short clamping member, and the threaded locking member cooperating to position the threaded rod member, sequentially;

(i) the threaded locking member having a cavity; and (j) the cavity being adapted to cooperate with an opposingly located raised section of the second short clamping member.

16. The single pull control horn of claim 15 further comprising:

(a) the cavity creating a coaction between an opposingly located raised section of the second short clamping member;

(b) the threaded locking member having an adjustable position relative to the second short clamping member in order to position the threaded;

(c) the cavity assisting with a position of the threaded rod member; and (d) the first short clamping member, the first base member, the second short clamping member, and the threaded locking member coacting to position the threaded rod member in a desired position;

(e) the threaded gripping rod being substantially perpendicular to a centerline of a component;

(f) the cavity having a tapered shape, thereby permitting the first clamping member and the second clamping to move by eliminating interference with the threaded rod;

(g) the first base member having a planar surface in contact with the component and an opposingly located raised section;

(h) the opposingly located raised section having an outer surface at least partially spherical in shape;

(i) the first base member having a base opening;

(j) the base opening extending through the base member;

(k) the base opening receiving the threaded rod therethrough;

(l) the cavity engaging the spherical outer surface of the clamping member; and (m) the cavity engaging communicating with an internally threaded bore of the threaded rod.

* * * * *